US008927910B2

(12) United States Patent
Wirtz et al.

(10) Patent No.: US 8,927,910 B2
(45) Date of Patent: Jan. 6, 2015

(54) HIGH POWER-DENSITY PLANE-SURFACE HEATING ELEMENT

(75) Inventors: Richard Wirtz, Reno, NV (US); Sean Penley, Reno, NV (US)

(73) Assignee: Board of Regents of the Nevada System of Higher Education, on Behalf of the University of Nevada, Reno, Reno, NV (US)

( * ) Notice: Subject to any disclaimer, the term of this patent is extended or adjusted under 35 U.S.C. 154(b) by 253 days.

(21) Appl. No.: 13/457,282

(22) Filed: Apr. 26, 2012

(65) Prior Publication Data

US 2012/0273481 A1 Nov. 1, 2012

Related U.S. Application Data

(60) Provisional application No. 61/481,016, filed on Apr. 29, 2011.

(51) Int. Cl.
*H05B 3/30* (2006.01)
*H05B 3/10* (2006.01)
*H05B 3/26* (2006.01)

(52) U.S. Cl.
CPC .. *H05B 3/10* (2013.01); *H05B 3/26* (2013.01); *H05B 2203/009* (2013.01); *H05B 2203/013* (2013.01)
USPC ..... 219/539; 219/540; 219/541; 219/544

(58) Field of Classification Search
CPC ..... H05B 3/03; H05B 3/22; H05B 2203/009; H05B 2203/01; H05B 2203/013; H05B 2203/021; F22B 1/288
See application file for complete search history.

(56) References Cited

U.S. PATENT DOCUMENTS

| | | | | | |
|---|---|---|---|---|---|
| 2,316,505 | A | * | 4/1943 | Bry, Jr. | 219/224 |
| 2,540,295 | A | * | 2/1951 | Schreiber | 219/213 |
| 3,143,640 | A | * | 8/1964 | Becker | 219/494 |
| 4,631,391 | A | * | 12/1986 | Tiepke | 219/541 |
| 4,730,102 | A | * | 3/1988 | Melanson | 219/541 |
| 4,783,587 | A | * | 11/1988 | Ishii et al. | 219/548 |
| 4,904,850 | A | * | 2/1990 | Claypool et al. | 219/548 |

(Continued)

FOREIGN PATENT DOCUMENTS

| | | | | | |
|---|---|---|---|---|---|
| DE | 102006001791 | A1 | * | 8/2006 | |
| WO | WO 9323968 | A1 | * | 11/1993 | H05B 3/10 |

OTHER PUBLICATIONS

Kandlikar. "A Theoretical Model to Predict Pool Boiling CHF Incorporating Effects of Contact Angle and Orientation." *ASME J. Heat Transfer*, 123, pp. 1071-1079 (2001).

(Continued)

*Primary Examiner* — Joseph M Pelham
(74) *Attorney, Agent, or Firm* — Klarquist Sparkman, LLP

(57) ABSTRACT

An electrical heat production device comprising a thin resistive layer sandwiched between a pair of plates having high thermal and electrical conductivity, the stack of layers being insulated around the side surfaces. When a voltage potential is applied across the plates in the disclosed electrical heat production device, an electrical current flows across the resistive layer producing heat within the resistive layer that is conducted through the plates and across the outer surfaces of the plates. A guard heater can be positioned adjacent to one of the outer plate surfaces to bias the heat flow from the resistive layer toward the opposite outer plate surface, such that the apparatus can have a single planar heating surface.

21 Claims, 3 Drawing Sheets

(56) References Cited

U.S. PATENT DOCUMENTS

| | | | | |
|---|---|---|---|---|
| 4,990,755 | A * | 2/1991 | Nishimura | 219/553 |
| 6,084,206 | A * | 7/2000 | Williamson et al. | 219/212 |
| 6,223,423 | B1 * | 5/2001 | Hogge | 29/621 |
| 7,977,610 | B2 * | 7/2011 | Hamburger et al. | 219/537 |
| 8,362,406 | B2 * | 1/2013 | Bohlender et al. | 219/548 |
| 2001/0003336 | A1 * | 6/2001 | Abbott et al. | 219/543 |
| 2007/0210073 | A1 * | 9/2007 | Hubert et al. | 219/535 |
| 2011/0198341 | A1 * | 8/2011 | Gilmore | 219/539 |

OTHER PUBLICATIONS

Laca, et al. "Sub-atmospheric pressure pool boiling of water on a screen laminate-enhanced extended surface." Semiconductor Thermal Measurement and Management Symposium, 2009. SEMI-THERM 2009. *25th Annual IEEE*. IEEE, 2009.

Laca, et al. "Flow Boiling of Sub-Cooled Pentane on a Micro-Porous Coating." *ASME 2012 6th International Conference on Energy Sustainability collocated with the ASME 2012 10th International Conference on Fuel Cell Science, Engineering and Technology*. American Society of Mechanical Engineers, (2012).

Laca, et al. "Impingement-Flow Boiling on a Structured-Porous Metallic Coating." *ECI 8th International Conference on Boiling and Condensation Heat Transfer, Ecole Polytechnique Fédérale de Lausanne*, Jun. 3-7, 2012 Lausanne, Switzerland, (2012).

Liter, et al. "Pool-boiling enhancement by modulated porous-layer coating: theory and experiment." *IJHMT*, 44, pp. 4287-4311 (2001).

Penley, et al. "Mechanistic Study of Subatmospheric Pressure, Subcooled, Flow Boiling of Water on Structured-Porous Surfaces." *Journal of Heat Transfer*, 134.11, pp. 112902-01-112902-08 (2012).

Penley, et al. "Correlation of sub-atmospheric pressure, saturated, pool boiling of water on a structured-porous surface." *ASME J Heat Transfer*, 133 (2011).

Penley, et al. "Sub-Atmospheric Pressure, Subcooled, Flow Boiling of Water on Screen Laminate Enhanced Surfaces." *2010 14th International Heat Transfer Conference*. American Society of Mechanical Engineers, (2010).

Sloan, et al. "Sub-Atmospheric Pressure Pool Boiling of Water on a Screen-Laminate Enhanced surface." *25th IEEE SEMI-THERM Symposium*, pp. 246-253 (2009).

Xu, et al. "In-plane effective thermal conductivity of plain-weave screen laminates." *IEEE Transactions on Components and Packaging Technologies*, 25(4), pp. 615-620 (2002).

* cited by examiner

HIGH POWER-DENSITY PLANE-SURFACE HEATING ELEMENT

CROSS REFERENCE TO RELATED APPLICATION

This application claims the benefit of U.S. Provisional Application No. 61/481,016, filed Apr. 29, 2011, which application is incorporated herein in its entirety.

ACKNOWLEDGMENT OF GOVERNMENT SUPPORT

This invention was made with government support under contract N00014-07-1-0670 awarded by the Office of Naval Research. The government has certain rights in the invention.

FIELD OF THE DISCLOSURE

This application relates to plane surface electrical heating elements as well as systems and methods relating to the same.

BACKGROUND

A conventional plane-surface heater consists of a resistive element that is encapsulated in electrical insulation. The resistive element is either fine wire, such as nichrome or tungsten, or it is a conductive, thin-film metallic or graphite deposition. For high power-density applications, the insulation is usually a ceramic such as mica or alumina. With application of electrical power, current flows in the plane of the resistive element. The resistive element temperature $T_e$ rises and heat (q) is conducted across the insulation. The temperature of the resistive element is related to the heat transfer rate as:

$$T_e - T_s \approx (q/A_s)((t/k)+R'')$$

where $T_s$ and $A_s$ are the heater insulation surface temperature and surface area per side, respectively; k and t are the insulation thermal conductivity and thickness, respectively; and R" is the resistive element-to-insulation contact thermal resistivity. The total thermal resistivity, (t/k)+R" is a performance limiter since it is usually relatively large.

An example is a mica insulated flat heater (k=0.71 W/mK, t=0.3 mm). At 500 W/cm$^2$ per side power density ($q/A_s$), and assuming R"=0, the element temperature rise across the mica insulation would be $T_e - T_s \approx 2100°$ C., which is not feasible. If the resistive element is nichrome, the element would melt. Consequently, the manufacturer limits power density of the mica-insulated plane-surface heater to 17.1 W/cm$^2$ when $T_s$=150° C., and the maximum permissible power density decreases to zero when $T_s$=600° C. Similarly, another exemplary plane-surface heating element that includes pyrolytic graphite (PG) encapsulated in pyrolytic boron nitride (PBN) insulation is limited to power densities of less than 50 W/cm$^2$.

SUMMARY

Disclosed herein are exemplary embodiments of high-power plane-surface production devices and heating system and methods related thereto.

An exemplary electrical heat production apparatus comprises: a resistive layer having a first planar surface, an opposing second planar surface, and side edges, the resistive layer having a thickness in a direction transverse to the first and second surfaces, the resistive layer having a first electrical conductivity; a first plate having an inner planar surface, an opposing outer planar surface, and side edges, the inner surface being joined to the first surface of the resistive layer, the first plate having an electrical conductivity that is greater than the first electrical conductivity; a second plate having an inner planar surface, an opposing outer planar surface, and side edges, the inner surface of the second plate being joined to the second surface of the resistive layer, the second plate having an electrical conductivity that is greater than the first electrical conductivity; a thermal and electrical insulation material insulating the side edges of the resistive layer, the side edges of the first plate and the side edges of the second plate, the insulation material having an electrical conductivity that is lower than the first electrical conductivity; and a first terminal electrically coupled to the first plate and a second terminal electrically coupled to the second plate, such that when a voltage potential is applied across the first and second terminals an electrical current flows through the first plate, across the thickness of the resistive layer and through the second plate. The electrical current is converted into heat within the resistive layer, the heat being conducted from the resistive layer, through the first and second plates, and across the outer surfaces of the first and second plates.

In some embodiments, the resistive layer has an electrical resistivity between 10 Ωcm and 5000 Ωcm.

In some embodiments, the first and second plates comprise a bondable, thermally and electrically conductive elemental metal, alloy, or semimetal. In some embodiments, the first and second plates comprise one or more materials selected from a group consisting of gold, copper, silver, beryllium copper and pyrolytic graphite.

In some embodiments, the power density at the outer surfaces of the first and second plates is greater than 500 W/cm$^2$. In some of these embodiments, the temperature drop between the inner and outer surfaces of the plates is less than 40° K.

In some embodiments, the outer planar surfaces of the first and second plates are free of the insulation material. In some embodiments, the insulation material only contacts the side edges of the first and second plates.

Another exemplary heating apparatus comprises: a resistive layer having an upper planar surface, an opposing lower planar surface, and side edges, the resistive layer having a thickness in a direction transverse to the upper and lower surfaces, the resistive layer having a first electrical conductivity; a first plate having an upper planar surface, an opposing lower planar surface, and side edges, the lower surface being joined to the upper surface of the resistive layer with a first controlled expansion layer, the first plate having an electrical conductivity that is greater than the first electrical conductivity; a second plate having an upper planar surface, an opposing lower planar surface, and side edges, the upper surface of the second plate being joined to the lower surface of the resistive layer with a second controlled expansion layer, the second plate having an electrical conductivity that is greater than the first electrical conductivity; a third plate having an upper planar surface, an opposing lower planar surface, and side edges, the upper surface of the third plate being adjacent to and spaced from to the lower surface of the second plate with a first layer of insulation therebetween, the third plate having an electrical conductivity that is greater than the first electrical conductivity; a guard heater having an upper planar surface, an opposing lower planar surface, a first side edge, an opposing second side edge, and a resistive element, the upper surface of the guard heater being adjacent to and spaced from to the lower surface of the third plate with a second layer of insulation therebetween; an insulation material insulating the side edges of the resistive layer, the first plate, the second plate, the third plate, and the guard heater, the insulation material further insulating the lower surface of the guard heater, the insulation material and the insulation layers having an electrical conductivity that is lower than the first electrical conductivity; and a first terminal electrically coupled to the first plate, a second terminal electrically coupled to the second plate, and third and fourth terminals electrically coupled to opposite ends of the resistive element of the guard heater, such that when a first voltage potential is applied across the first and second terminals an electrical current flows through the first plate, across the thickness of the resistive layer and through the second plate, and when a second voltage potential is applied across the third and fourth terminals an electrical current flows through the resistive element of the guard heater. The electrical current flowing through the guard heater produces first heat and the electrical current flowing across the resistive layer produces second heat within the resistive layer such that the temperature of the second plate is about equal to the temperature of the third plate and substantially all of the second heat is conducted from the resistive layer, through the first plate, and across the upper surface of the first plate.

In some embodiments, the electrical resistivity of the resistive layer is between 10 Ωcm and 5000 Ωcm. In some embodiments, the thickness of the resistive layer is from about 50 μm to about 2000 μm. In some embodiments, the resistive layer comprises a bondable material comprising a semiconductor, a semimetal, a ceramic, a conductive polymer or a composite of these materials.

In some embodiments, the first plate comprises a bondable, thermally and electrically conductive elemental metal, alloy, or semimetal.

In some embodiments, the first controlled expansion layer comprises a copper/tungsten composite. In some embodiments, the lower surface of the first plate is vacuum brazed or sintered to the first controlled expansion layer. In some embodiments, the first controlled expansion layer is vacuum brazed or sintered to the upper surface of the resistive layer.

In some embodiments, the thickness of the resistive layer is between 50 μm and 2000 μm, the first plate has a thickness of between 0.1 mm and 3.5 mm, and the first controlled expansion layer has a thickness of between 0.1 mm and 1.5 mm.

In some embodiments, substantially all heat produced within the resistive layer is conducted to the upper surface of the first plate.

In some embodiments, a temperature at the lower surface of the resistive layer is greater than a temperature at the upper surface of the resistive layer.

In some embodiments, a power density is 500 W/cm$^2$, a temperature difference between the upper and lower surfaces of the first plate is less than 40° K., a temperature difference between the lower surface of the first plate and the upper surface of the resistive layer is less than 30° K., and a temperature difference between the upper and lower surfaces of the resistive layer is less than 15° K.

In some embodiments, when a power density is 500 W/cm$^2$, a temperature difference between the upper surface of the first plate and the lower surface of the resistive layer is less than 75° K.

In some embodiments, the apparatus is capable of producing at least 500 W/cm$^2$ of heat at the upper surface of the first plate. In some embodiments, the apparatus is capable of producing at least 1000 W/cm$^2$ of heat at the upper surface of the first plate. In some embodiments, the apparatus is capable of producing at least 100 kW of heat at the upper surface of the first plate.

In some embodiments, the upper surface of the first plate has a surface area of at least 100 cm$^2$.

In some embodiments, at the interface between the upper surface of the resistive element and the lower surface of the controlled expansion layer, a maximum strain gradient in the plane of the interface is less than 0.1 μm per mm cross-interface.

An exemplary system for controlled distillation of temperature sensitive materials comprises a heating apparatus as described above, a power supply, and a controller, wherein the upper surface of the first plate is configured to transfer heat to a high-flux liquid boiling surface to vaporize a liquid adjacent to the boiling surface.

In some embodiments, the liquid is water at 25° C. at 0.2 atm pressure, the surface area of the upper surface of the first plate is 10 cm$^2$, and the system is capable of producing at least 7.25 kg/hr of water vapor.

In some embodiments, the controller is configured to adjust the output of the power supply to adjust the heat output of the apparatus.

The foregoing and other features of the disclosure will become more apparent from the following detailed description of several embodiments which proceeds with reference to the accompanying figures.

DETAILED DESCRIPTION

Various exemplary embodiments of plane surface electrical heating elements, as well as systems and methods relating to the same, are disclosed herein. The following description is exemplary in nature and is not intended to limit the scope, applicability, or configuration of the invention in any way. Various changes to the described embodiments may be made in the function and arrangement of the elements described herein without departing from the scope of the invention.

As used in this application, the singular forms "a," "an," and "the" include the plural forms unless the context clearly dictates otherwise. Additionally, the term "includes" means "comprises." Further, the term "coupled" generally means electrically, electromagnetically, and/or physically (e.g., mechanically or chemically) coupled, joined or linked and does not exclude the presence of intermediate elements between the coupled or associated items absent specific contrary language.

Exemplary heating devices disclosed herein comprise a compact, layered composite that circumvents the issue of conduction across low thermal conductivity electrical insulation such that there is only a relatively small temperature rise of the resistive heating element component.

Figure 1:
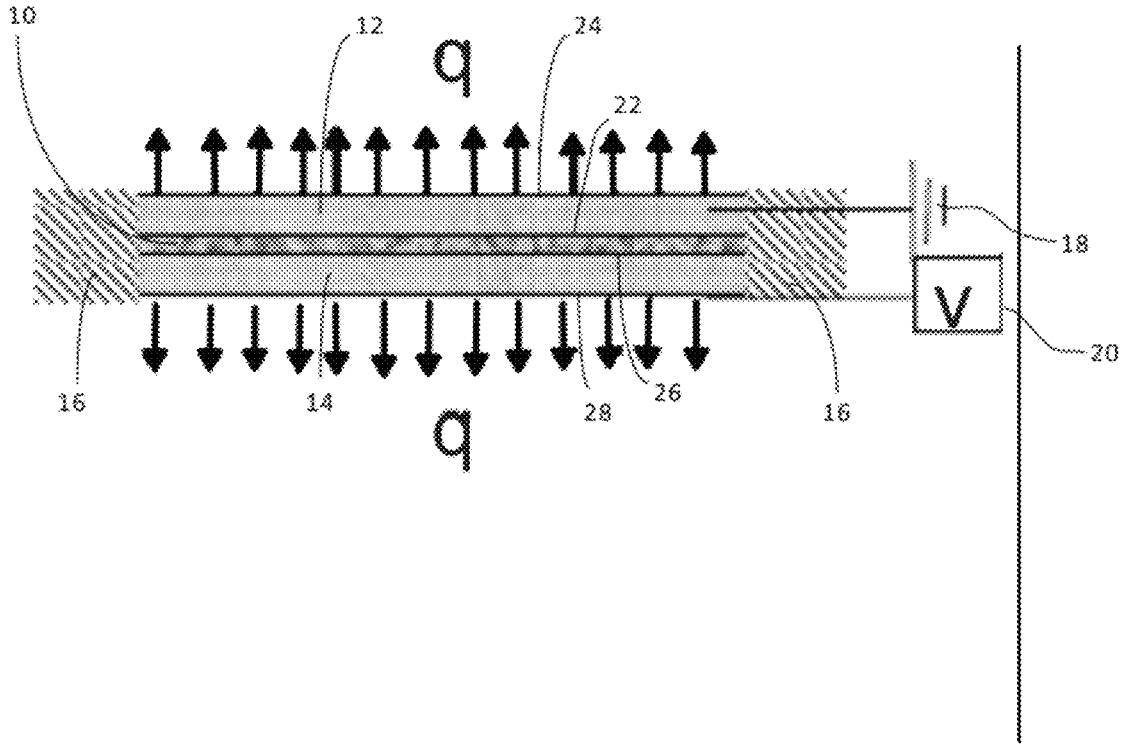
FIG. 1 is cross-sectional view of an exemplary heating device comprising a resistive layer sandwiched between a pair of plates.

As shown in FIG. 1, in one embodiment, the layered composite can comprise a thin resistive layer 10 sandwiched between two plates, or busbars, 12, 14. A voltage potential can be applied to the plates 12, 14 such that current flows across the plane of the resistive layer 10. In FIG. 1, a voltage source 20 is electrically coupled to the lower plate 14 and a ground 18 is electrically coupled to the upper plate 12. The side edges of the resistive layer 10 and the plates 12, 14 can be electrically and thermally insulated with insulation material 16, while the upper and lower surfaces of the device can be free of insulation. In some embodiments, one of these upper and lower surfaces of the device can also be insulated, leaving one un-insulated planar surface for heat transfer.

The resistive layer 10 can comprise a bondable material having an electrical resistivity ρ, where 10 Ωcm<ρ<5000 Ωcm. In some embodiments, the resistive layer 10 comprises a bondable material having a ρ, where 100 Ωcm<ρ<1000 Ωcm. Exemplary materials can include semiconductors such as silicon, semimetals such as pyrolytic graphite, ceramics such as silicon carbide, conductive polymers, and/or composites of these materials. The magnitude of the electrical resistivity can be application specific.

The plates 12, 14 can comprise bondable, thermally and electrically conductive material, such as gold, copper or silver; a bondable, thermally and electrically conductive alloy such as beryllium copper; a semimetal such as pyrolytic graphite; or a combination of these materials. The upper plate 12 can have a lower planar surface bonded to an upper planar surface of the resistive layer at interface 22 and the lower plate 14 can have an upper planar surface bonded to a lower planar surface of the resistive layer at interface 26. Heat produced within the resistive layer is conducted evenly toward both plates 12, 14. The plates spread the heat laterally across the plates such that the heat q is evenly distributed across the outer surfaces 24, 28 of the plates. The temperature difference between the interfaces 22, 26 and the outer surfaces 24, 28, respectively, can be minimized compared to other heating devices wherein the heat must be conducted through electrical insulation layers having high thermal resistance.

Figure 2:
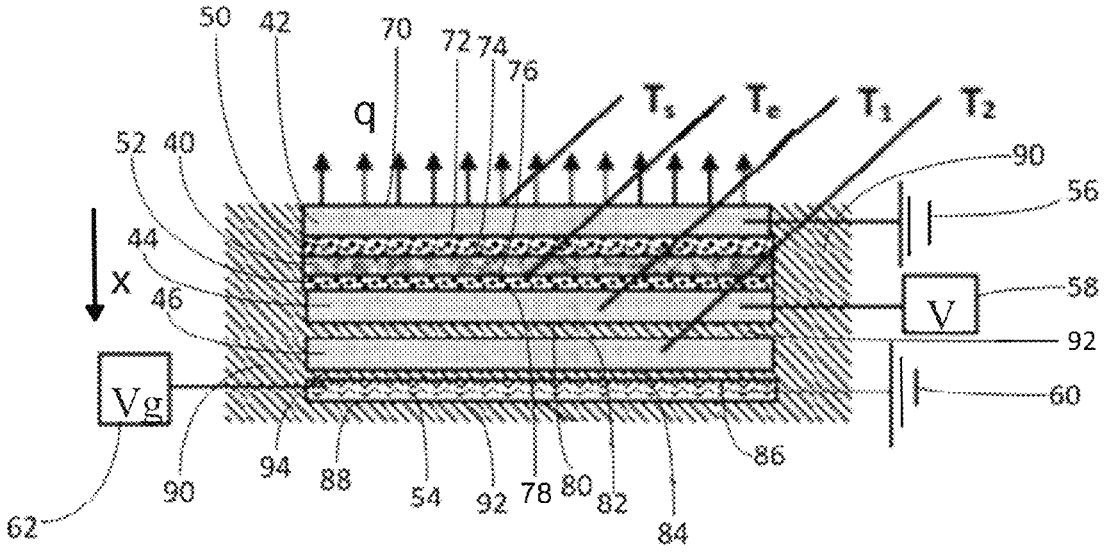
FIG. 2 is a cross-section view of another exemplary heating device comprising a guard heater.

FIG. 2 shows another exemplary heating device embodiment that circumvents the issue of conduction across low thermal conductivity electrical insulation such that there is only a relatively small temperature rise of the resistive heat production component. The heating device of FIG. 2 comprises a composite stack of several layers of different materials, the stack being thermally and electrically insulated on the side edges of all the layers and around the bottom of the stack with an insulation material 90, 92.

The heat production component of the device can comprise a resistive layer 40, which can comprise a semiconductor such as silicon (ρ≈600 Ωcm), a semimetal such as pyrolytic graphite, a ceramic such as silicon carbide, conductive polymers, and/or composites of these materials. In some embodiments, for example, the resistive layer 40 can comprise an n-type phosphorus-doped silicon crystal. The thickness of the resistive layer can depend on ρ, the characteristics of the power source 58, and/or the target heating density $q/A_2$ at the upper surface 70. The resistive layer 40 can have a thickness of from about 50 μm to about 2000 μm, including about 100 μm to about 1000 μm, about 200 μm to about 800 μm, and about 300 μm to about 500 μm, such as about 100 μm, about 200 μm, about 300 μm, about 400 μm, about 500 μm, about 600 μm, about 700 μm, about 800 μm, about 1000 μm, or about 1500 μm. The resistive layer 40 can comprise an upper planar surface, a lower planar surface, and side edge surfaces.

The device can further comprise a plurality of bondable plates comprising material having high electrical and thermal conductivity, such as gold, copper or silver; a bondable, thermally and electrically conductive alloy such as beryllium copper; a semimetal such as pyrolytic graphite; or combinations of these materials. Three such plates are shown in FIG. 2, a first plate 42, a second plate 44 and a third plate 46. The plates can have a thickness from about 0.10 mm to about 100 mm, including about 0.50 mm to about 50 mm, about 1 mm to about 10 mm, including about 0.10 mm, about 0.20 mm, about 0.30 mm, about 0.40 mm, about 0.50 mm, about 0.75 mm, about 1 mm, about 2 mm, about 3 mm, about 4 mm, about 5 mm, about 6 mm, about 7 mm, about 8 mm, about 9 mm, about 10 mm, about 50 mm, or about 100 mm. For a given application, the thicknesses of the plates can be selected based on the electrical resistivity of the plate material, the voltage/current characteristics of the power source 58, and/or the cross-plane thermal conductivity of the plate material. Embodiments of the heating device having thinner plates, for example, can respond faster to changes in the voltage/current characteristics of the power source 58.

Each of the plates 42, 44, and 46 can have upper planar surfaces, lower planar surfaces and side edge surfaces. The first and second plates 42, 44 can be bonded, such as vacuum brazed, sintered and/or diffusion bonded, to controlled expansion layers 50, 52, respectively, which can in turn be bonded, such as vacuum brazed, sintered, and/or diffusion bonded, to opposite sides of the resistive layer 40. The controlled expansion layers 50, 52 can comprise a composite material, such as aluminum/silicon carbide, copper/diamond, copper/graphite, copper/molybdenum or copper/tungsten, having a thermal expansion coefficient between that of the resistive layer 40 and the plates 42, 44 to accommodate the thermal expansion mismatch between the resistive layer and the plates. The controlled expansion layers 50, 52 can have a thickness between about 0.10 mm and about 10 mm, 0.10 mm to about 10 mm, including about 0.50 mm to about 5 mm, about 1 mm to about 3 mm, including about 0.10 mm, about 0.20 mm, about 0.30 mm, about 0.40 mm, about 0.50 mm, about 0.75 mm, about 1 mm, about 2 mm, about 3 mm, about 4 mm, about 5 mm, about 6 mm, about 7 mm, about 8 mm, about 9 mm, or about 10 mm.

In some embodiments, one or more additional intermediate layers or materials can be positioned at one or more of the interfaces 72, 74, 76 and 78 (see FIG. 2). This intermediate material can comprise a thin film adhesion promoting material, such as aluminum, chromium, nickel, titanium and/or tungsten.

The lower surface of the first plate 42 can be bonded at interface 72 to the controlled expansion layer 50, which can be bonded at interface 74 to the upper surface of the resistive layer 40. The upper surface of the second plate 44 can be bonded at interface 78 to the controlled expansion layer 52, which can be bonded at interface 76 to the lower surface of the resistive layer 40.

The third plate 46 can be positioned below the second plate, the second and third plates being separated by a thin insulation layer 92, which abuts the lower surface of the second plate at interface 80 and abuts the upper surface of the third plate at interface 82. In other embodiments, a thin film heat flux gage can be substituted in place of the insulation layer 92. In some embodiments, the three plates 42, 44 and 46 can comprise the same material, the same thickness, and/or the same thermal and electrical conductivity. In other embodiments, these properties of the plates can vary.

The heating device can further comprise a guard heater 54 positioned below the third plate 46, the guard heater and the third plate being separated by a insulation layer 94, which abuts the lower surface of the third plate at interface 84 and abuts an upper planar surface of the guard heater 54 at interface 86. Insulation 92 can surround the lower planar surface of the guard heater 54 at interface 88 in addition to the side edge surfaces of the entire stack of layers. The guard heater 54 can comprise a resistive element, such as a deposition or a wire, that is laid out in a serpentine pattern between electrical terminals.

A voltage potential can be applied between the first and second plates 42, 44 such that electrical current flows across resistive layer 40 in a direction normal to the interfaces 74 and 76. A voltage source 58 can be applied to one of the first and second plates 42, 44 and a ground 56 can be applied to the other to create the voltage potential. The direction of current flow can be irrelevant. The current flowing through the resistive layer 40 creates heat q within the resistive layer and all, more than half, or at least some, of the heat q is conducted across the controlled expansion layer 50 and the first plate 42 to the upper surface 70 of the first plate. In embodiments not including the guard heater 54, a portion, such as about half, of the heat q can be conducted away from the resistive layer 40 via the controlled expansion layer 52 and the second plate 44.

The guard heater 54 can bias flow of the heat q from the resistive layer 40 toward the first plate 42. As shown in FIG. 2, a voltage potential can be applied laterally across the guard heater via a voltage source 62 and a ground 60 electrically coupled to opposing side edge surfaces of the guard heater and the current flowing through the guard heater can produce additional heat. The insulation layer 84 can be thinner than the insulation 92 covering the lower surface of the guard heater 54 such that substantially all of the heat produced by the guard heater is conducted upward across interfaces 86 and 84 to the third plate 46.

If the power to the guard heater 54 is adjusted such that the temperature of the second plate $T_1$ equals the temperature of the third plate $T_2$, then heat flow from the resistive layer 40 toward the lower portion of the heating device can be minimized and/or prevented and all or substantially all the heat q generated in the resistive layer 40 can be projected to the first plate 42. Furthermore, the resistive element 40 can have a highest temperature $T_e$ at the lower surface 76 of the resistive layer 40 and a lower temperature at the upper surface 74.

The temperature distribution in the upper three layers (the first plate 42, the controlled expansion layer 50, and the resistive layer 40) of the heating device in the x-direction (as indicated in FIG. 2, with x being 0 at the upper heat transfer surface 70 of the first plate 42), neglecting the bonds between these three layers, is given by the following zonal equations:

First plate 42: $T_{42}(x)-T_s=(q''_s/k_{42})x$:

Controlled expansion layer 50: $T_{50}(x)-T_{42}(t_{42})=(q''_s/k_{50})(x-t_{42})$;

Resistive layer 40: $T_{40}(x)-T_{50}(t_{42}+t_{50})=(q''_s/(2k_{40}t_{40}))[(t_{40})^2-((t_{tot})^2-x^2)]$;

where $q''_s$ is the power density [W/cm$^2$] and is equal to $q/A_s$ where $A_s$ is the surface area of the upper surface of the first plate 42, $t_{tot}$ is the total thickness of the three layers ($t_{42}+t_{50}+t_{40}$), k is the thermal conductivity, and x is measured from the heat transfer surface 70.

Figure 3:
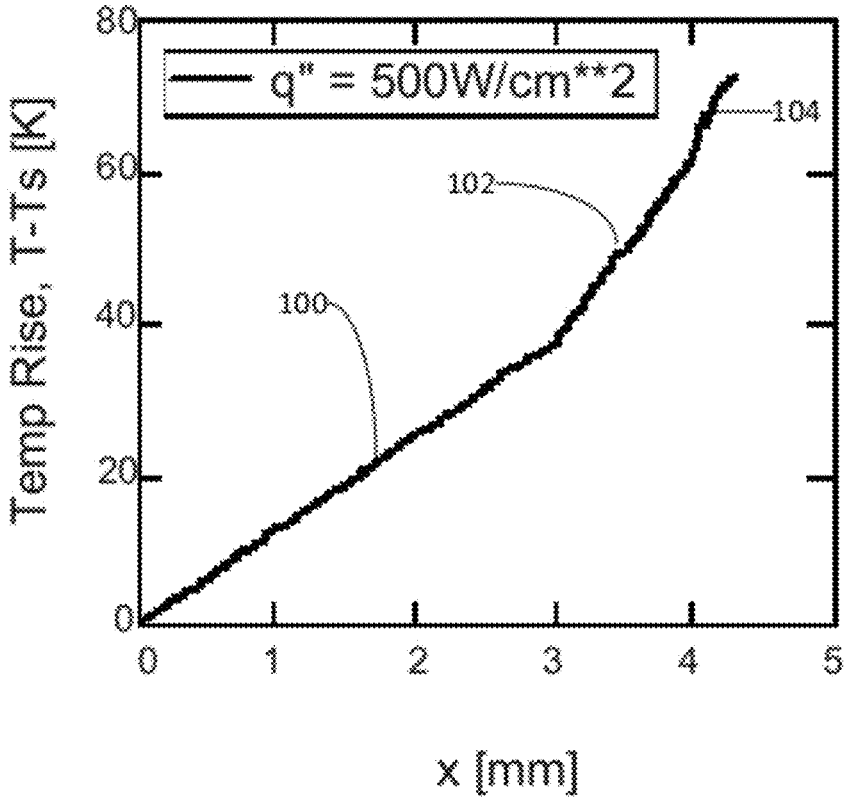
FIG. 3 is a graph of temperature rise across an exemplary heating device as a function of distance from an outer heat transfer surface.

In one exemplary embodiment, the first plate 42 is made of oxygen-free copper, $t_{42}$ is 3 mm, $k_{42}$ is 401 W/mK, the controlled expansion layer 50 is made of a 15/85 copper-tungsten composite, $t_{50}$ is 1 mm, $k_{50}$ is 208 W/mK, the resistive layer 40 is a silicon crystal, $t_{40}$ is 0.3 mm, and $k_{40}$ is about 70 W/mK. FIG. 3 plots the temperature profile of this embodiment when the power density $q''_s$=500 W/cm$^2$. As shown in FIG. 3, the temperature increases linearly across the copper plate 42 (see segment 100) with a temperature change $\Delta T_{42}$ of about 37K, the temperature increases linearly across and the Cu:W layer 50 (see segment 102) with a temperature change $\Delta T_{50}$ of about 24K, and the temperature rise across the resistive layer 40 (see segment 104) is about 11K, making the total temperature rise across the heating element, $T_e(max)-T_s$, equal to about 72K. Given that $A_s$=4 cm$^2$ in this embodiment, the device can produce about 2 kW (94.8 volts×21.1 amps) when the power density $q''_s$=500 W/cm$^2$.

In this exemplary embodiment, the maximum lateral strain gradient (at the silicon/Cu:W interface 74) is a mere 0.08 μm lateral/mm cross-plane, and decreases linearly to zero at the other side (interface 76) of the resistive layer 40.

Because the temperature rise across the heating element is low, this exemplary device can function with a power density in excess of 1000 W/cm$^2$ without damaging the components. Having a 4 cm$^2$ plan area $A_s$, the device can provide in excess of 4.0 kW. In other embodiments, the plan area $A_s$ of the device can exceed 100 cm$^2$, making them capable of providing in excess 100 kW.

The thermal conductivity of the plates 42, 44, 46 are typically greater than the thermal conductivity of the resistive layer 40, but not necessarily. Desirably, the plates and the resistive layer have a high thermal conductivity since this minimizes the temperature excursion exhibited in FIG. 3. Moreover, the thermal and/or electrical conductivity of the first plate does not necessarily match that of the second or third plates, though all three plates can be the same in some embodiments. In other embodiments where the lower plates are guarded, the second plate 44 can have a lower thermal conductivity that the first plate, encouraging heat to flow more toward the first plate, and reducing the power demand for the guard heater 54. The thicknesses of the plates can also vary to adjust the heat flow patterns across the plates and the power demand of the guard heater.

The heating devices disclosed herein can provide a safe, compact, and highly controllable planar heating source. There are no open flames or excessively high surface temperatures (2000° C.) like with open flame heating devices. In addition, the heating devices disclosed herein do not produce exhaust gasses or other undesirable byproducts. Furthermore, the temperature of the heating surface can be easily and accurately controlled by adjusting the voltage/current across the first and second plates. The heating device can be controlled using only an AC or DC power supply and controller. Other advantages and benefits can include, but are not limited to:

- Twenty-fold (20×) increase in maximum heat flux performance over existing technology
- Faster thermal response compared to existing technology
- Simple, robust architecture
  - Heating System=heating element+power supply+power controller
  - Variable size and plan form shape: 0 to ≈100 cm$^2$
  - Tunable voltage/current ratio (DC or AC)
  - Bondable external surface (adhesive or braze)
  - Tolerant to harsh environments
  - No hazardous materials or pollutants
  - Receptive to guard heater architecture (unidirectional heat flow)
- Straightforward fabrication
- Economical and environmentally friendly alternative to:
  - Complex burner gas (flame heating) systems
  - High-temperature radiant systems
  - Laser irradiation systems The heating devices disclosed herein can be incorporated into a compact heating system, such as a mini-evaporator for controlled distillation of temperature sensitive materials. For example, in one embodiment of a compact heating system, the surface 70 of the heating device shown in FIG. 2 can be coupled, such as bonded, to a high-flux boiling surface to produce vapor, such as described by Penley and Wirtz [S. J. Penley and R. A. Wirtz (2011) "Correlation of Sub-atmospheric Pressure, Saturated, Pool Boiling of Water on a Structured-Porous Surface," ASME JHT, Vol. 133, 041501 (11 pgs.)], which is incorporated by reference herein. For example, according to Penley and Wirtz [S. J. Penley and R. A. Wirtz (2010) "Sub-atmospheric pressure, sub-cooled flow boiling of water on screen-laminate enhanced surfaces", Porc. IHTC14, Paper IHTC14-22741 (10 pgs.)], which is incorporated by reference herein, it has been shown that the referenced high-flux boiling surface can accommodate up to 453 W/cm$^2$ when the liquid is 25° C. water at 0.2 atm pressure, such a mini-evaporator, with a $A_s$=10 cm$^2$, can produce up to 7.25 kg/hr vapor when it is incorporated into a flow-through distillation system. Other liquids can also be used, which produce different vapor production rates.

In view of the many possible embodiments to which the principles of this disclosure may be applied, it should be recognized that illustrated embodiments are only examples and should not be considered a limitation on the scope of the disclosure. Rather, the scope of the disclosure is defined by the following claims. We therefore claim all that comes within the scope and spirit of these claims.

We claim:

1. An apparatus, comprising:

a resistive layer having an upper planar surface, an opposing lower planar surface, and side edges, the resistive layer having a thickness in a direction transverse to the upper and lower surfaces, the resistive layer having a first electrical conductivity;

a first plate having an upper planar surface, an opposing lower planar surface, and side edges, the lower surface being coupled to the upper surface of the resistive layer with a first controlled expansion layer, the first plate having an electrical conductivity that is greater than the first electrical conductivity;

a second plate having an upper planar surface, an opposing lower planar surface, and side edges, the upper surface of the second plate being coupled to the lower surface of the resistive layer with a second controlled expansion layer, the second plate having an electrical conductivity that is greater than the first electrical conductivity;

a third plate having an upper planar surface, an opposing lower planar surface, and side edges, the upper surface of the third plate being adjacent to and spaced from the lower surface of the second plate with a first layer of insulation therebetween, the third plate having an electrical conductivity that is greater than the first electrical conductivity;

a guard heater having an upper planar surface, an opposing lower planar surface, a first side edge, an opposing second side edge, and a resistive element, the upper surface of the guard heater being adjacent to and spaced from to the lower surface of the third plate with a second layer of insulation therebetween;

an insulation material insulating the side edges of the resistive layer, the first plate, the second plate, the third plate, and the guard heater, the insulation material further insulating the lower surface of the guard heater, the insulation material and the insulation layers having an electrical conductivity that is lower than the first electrical conductivity; and a first terminal electrically coupled to the first plate, a second terminal electrically coupled to the second plate, and third and fourth terminals electrically coupled to opposite ends of the resistive element of the guard heater, such that when a first voltage potential is applied across the first and second terminals an electrical current flows through the first plate, across the thickness of the resistive layer and through the second plate, and when a second voltage potential is applied across the third and fourth terminals an electrical current flows through the resistive element of the guard heater;

wherein the electrical current flowing through the guard heater produces first heat and the electrical current flowing across the resistive layer produces second heat within the resistive layer such that the temperature of the second plate is about equal to the temperature of the third plate and substantially all of the second heat is conducted from the resistive layer, through the first plate, and across the upper surface of the first plate.

2. The apparatus of claim 1, wherein the electrical resistivity of the resistive layer is between 10 Ωcm and 5000 Ωcm.

3. The apparatus of claim 2, wherein the thickness of the resistive layer is from about 50 μm to about 2000 μm.

4. The apparatus of claim 1, wherein the resistive layer comprises a bondable material comprising a semiconductor, a semimetal, a ceramic, a conductive polymer, and/or a composite of these materials.

5. The apparatus of claim 1, wherein the first plate comprises a bondable, thermally and electrically conductive elemental metal, alloy, or semimetal.

6. The apparatus of claims 1, wherein the first controlled expansion layer comprises a copper/tungsten composite.

7. The apparatus of claim 1, wherein the lower surface of the first plate is vacuum brazed or sintered to the first controlled expansion layer.

8. The apparatus of claim 1, wherein the first controlled expansion layer is vacuum brazed or sintered to the upper surface of the resistive layer.

9. The apparatus of claim 1, wherein the thickness of the resistive layer is between 50 μm and 2000 μm, the first plate has a thickness of between 0.1 mm and 3.5 mm, and the first controlled expansion layer has a thickness of between 0.1 mm and 1.5 mm.

10. The apparatus of claim 1, wherein substantially all heat produced within the resistive layer is projected to the upper surface of the first plate.

11. The apparatus of claim 1, wherein a temperature at the lower surface of the resistive layer is greater than a temperature at the upper surface of the resistive layer.

12. The apparatus of claim 1, wherein, when a power density is 500 W/cm$^2$, a temperature difference between the upper and lower surfaces of the first plate is less than 40° K., a temperature difference between the lower surface of the first plate and the upper surface of the resistive layer is less than 30° K , and a temperature difference between the upper and lower surfaces of the resistive layer is less than 15° K.

13. The apparatus of claim 1, wherein when a power density is 500 W/cm$^2$, a temperature difference between the upper surface of the first plate and the lower surface of the resistive layer is less than 75° K.

14. The apparatus of claim 1, wherein the apparatus is capable of producing at least 500 W/cm$^2$ of heat at the upper surface of the first plate.

15. The apparatus of claim 1, wherein the apparatus is capable of producing at least 1000 W/cm$^2$ of heat at the upper surface of the first plate.

16. The apparatus of claim 1, wherein the apparatus is capable of producing at least 100 kW of heat at the upper surface of the first plate.

17. The apparatus of claim 9, wherein the upper surface of the first plate has a surface area of at least 100 cm$^2$.

18. The apparatus of claim 1, wherein, at the interface between the upper surface of the resistive element and the lower surface of the controlled expansion layer, a maximum strain gradient in the plane of the interface is less than 0.1 μm per mm cross-interface.

19. A system for controlled distillation of temperature sensitive materials, the system comprising the apparatus of claim 1, a power supply, and a controller, wherein the upper surface of the first plate is configured to transfer heat to a high-flux liquid boiling surface to vaporize a liquid adjacent to the boiling surface.

20. The system of claim 19, wherein the liquid is water at 25° C. at 0.2 atm pressure, the surface area of the upper surface of the first plate is 10 $cm^2$, and the system is capable of producing at least 7.25 kg/hr of water vapor.

21. The system of claim 20, wherein the controller is configured to adjust the output of the power supply to adjust the heat output of the apparatus.

* * * * *